United States Patent [19]

Elms

[11] 4,162,428

[45] Jul. 24, 1979

[54] VARIABLE INDUCTANCE BALLAST APPARATUS FOR HID LAMP

[75] Inventor: Robert T. Elms, Monroeville, Pa.

[73] Assignee: Westinghouse Electric Corp., Pittsburgh, Pa.

[21] Appl. No.: 920,291

[22] Filed: Jun. 29, 1978

[51] Int. Cl.[2] ..... H05B 41/36

[52] U.S. Cl. ..... 315/284; 315/199; 315/208; 315/307

[58] Field of Search ..... 315/194, 199, 208, 278, 315/279, 284, 291, 307, DIG. 7; 336/165

[56] References Cited

U.S. PATENT DOCUMENTS

| | | | |
|---|---|---|---|
| 3,374,396 | 3/1968 | Bell et al. | 315/284 X |
| 3,590,316 | 6/1971 | Engel et al. | 315/308 X |
| 3,873,910 | 3/1975 | Willis | 315/278 X |
| 3,886,405 | 5/1975 | Kubo | 315/DIG. 5 |
| 3,919,595 | 11/1975 | Willis | 315/278 X |
| 4,016,452 | 4/1977 | Willis | 315/278 |
| 4,037,148 | 7/1977 | Owens et al. | 315/194 X |

*Primary Examiner*—Eugene R. La Roche
*Attorney, Agent, or Firm*—W. D. Palmer

[57] ABSTRACT

Variable inductance ballast apparatus for high-intensity discharge (HID) lamp comprises a laminated E-I core having non-magnetic gaps intermediate the E-conformed and I-conformed members. A main winding is carried on a leg of the E-conformed member to provide two closed magnetic paths. A control winding is wrapped about another of the legs and encircles only one of the closed magnetic paths. A bilateral switch connects to the control winding and is actuated by a signal-generating means which is responsive to a lamp operating condition to close the bilateral switch once each half cycle of energizing potential during normal lamp operation, with the resulting counter mmf decreasing the inductance of the ballast apparatus by a predetermined amount to control in a very accurate, simple and inexpensive fashion the average power delivered to the lamp.

4 Claims, 3 Drawing Figures

VARIABLE INDUCTANCE BALLAST APPARATUS FOR HID LAMP

CROSS-REFERENCE TO RELATED APPLICATION

In copending application, Ser. No. 920,581, filed concurrently herewith is disclosed a circuit for sensing both lamp voltage and line voltage and to develop therefrom a composite control signal for actuating a bilateral switch to vary the inductance of a ballast apparatus. The sensing circuit is particularly designed to develop a control signal which can be varied over a very wide range of the phase of each half cycle of an alternating current potential so that only a relatively small change of inductance in the ballast apparatus is needed to achieve the proper degree of lamp power control. This is beneficial to lamp performance.

BACKGROUND OF THE INVENTION

This invention relates to variable inductance lamp ballast apparatus and, more particularly, to such a ballast apparatus which can be manufactured in a very accurate, simple and inexpensive fashion.

In U.S. Pat. No. 3,873,910, dated Mar. 25, 1975, to Willis is disclosed a ballast control device having variable inductance for use with HID lamps which comprises a main winding and a control winding positioned on opposite sides of an added, gapped shunt. When the control winding is closed, such as by means of a triac, the inductance of the device is decreased in order to control the average power delivered to the HID lamp.

U.S. Pat. No. 4,037,148, dated July 19, 1977, to Owens et al discloses a circuit for sensing a lamp operating condition to actuate a triac control such as used in the aforementioned U.S. Pat. No. 3,873,910.

U.S. Pat. No. 3,886,405, dated May 17, 1945, to Kubo discloses a large variety of different techniques for sensing the operating condition of an HID lamp in order to generate a control signal.

In U.S. Pat. No. 3,590,316, dated June 29, 1971, to Engel et al is disclosed an electronic wattmeter which can be used to generate a signal in order to control the wattage delivered to an HID lamp.

SUMMARY OF THE INVENTION

There is provided a variable inductance apparatus for ballasting a high-intensity discharge lamp with the apparatus comprising a laminated iron core member having an E-I configuration wherein the E-conformed part thereof comprises a main leg member having three transverse leg members connected thereto proximate the ends and midpoint thereof and projecting at right angles therefrom. The I-conformed part of the core member has dimensions similar to the main leg member and is positioned as a yoke proximate the projecting ends of the transverse leg members. Nonmagnetic gaps having predetermined spacings are provided intermediate the yoke member and at least two of the proximate projecting ends of the transverse leg members.

A main winding having a predetermined number of turns is wrapped about one of the transverse leg members and the main winding is connected in series circuit relationship with an AC energizing source and the HID lamp to be ballasted, with the main winding and the core member coacting to provide two close magnetic paths. A control winding is wrapped about a leg member of the core other than the leg member about which the main winding is wrapped and the control winding also encircles the flux path of only one of the two closed magnetic paths which are formed by the core and the main winding.

A bilateral switch which has a closed, conducting state and an open, non-conducting state connects to the control winding and a signal generating means is responsive to an operating condition of the ballasted lamp and is operable to actuate the bilateral switch to a closed state at a predetermined time in each half cycle of energizing potential for the operating HID lamp. On closing of the switch, the resulting counter mmf generated in one of the closed magnetic paths of the core member decreases by a predetermined amount the inductance of the apparatus to control in a predetermined fashion the average power delivered to the operating HID lamp.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
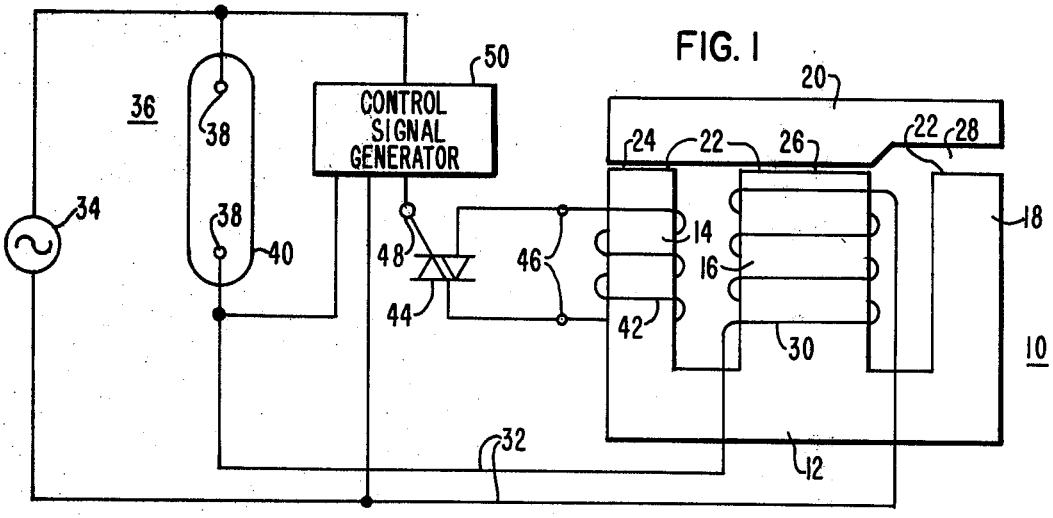
FIG. 1 is a schematic diagram of the present variable inductance ballasting apparatus with the ballasted lamp and signal generating device shown schematically and with the variable inductor shown in its preferred configuration.

In the schematic showing of FIG. 1, the variable inductance device 10 comprises a laminated iron core member having an E-I configuration wherein the E-conformed part thereof comprises a main leg member 12 having three transverse leg members 14, 16 and 18 connected thereto proximate the ends and midpoint thereof and projecting at right angles therefrom. The I-conformed part 20 of the core member has dimensions similar to the main leg member 12 and is positioned as a yoke proximate the projecting ends 22 of the transverse leg members 14, 16 and 18. Non-magnetic gaps 24, 26 and 28 having predetermined spacings are provided intermediate the yoke member 20 and the proximate projecting ends 22 of the transverse leg members 14, 16 and 18.

As a specific example, the laminated iron core is of simplified construction designed to be punched from magnetic iron sheet with a minimum of scrap. The main leg member 12 has dimensions of $\frac{7}{8}$ in.$\times 5\frac{1}{4}$ in. (2.2 cm$\times$13.3 cm), the leg member 14 has dimensions of $\frac{7}{8}$ in.$\times 2\frac{5}{8}$ in. (2.2 cm$\times$6.7 cm), the leg member 16 has dimensions of $1\frac{3}{4}$ in.$\times 2\frac{5}{8}$ in. (4.4 cm$\times$6.7 cm), and the leg member 18 has overall dimensions of $\frac{7}{8}$ in.$\times 2\frac{5}{8}$ in. (2.2 cm$\times$6.7 cm). The yoke member 20 has dimensions of $\frac{7}{8}$ in.$\times 5\frac{1}{4}$ in. (2.2 cm$\times$13.3 cm) and it is positioned with respect to the E-conformed member so that the gap 24 has a predetermined spacing of 35 mils (889 microns), the gap 26 is identical to the gap 24 and the gap 28 has a spacing of 160 mils (4.064 mm). The iron core member is formed from magnetic iron sheet having a thickness of 0.014 in. (0.356 mm) and formed of 100 laminations. The non-magnetic gaps 24, 26 and 28 can be air gaps or they can be maintained with a suitable non-magnetic material such as specially prepared paper or other suitable insulator.

A main winding 30 having a predetermined number of turns such as 400 is wrapped about the transverse leg member 16 which connects to the main leg member 12 proximate the midpoint thereof. There are also provided means such as suitable leads 32 for connecting the main winding 30 in series circuit relationship with an AC energizing source 34 and the high intensity discharge lamp 36 to be ballasted. In this embodiment, the main winding and the core member coact to provide two closed magnetic paths. As a specific example, for ballasting a 250 watt HID sodium lamp 36 from an AC source 34 of 240 volts, 60 Hz, the effective inductance is such that with the control winding not actuated, the impedance of the composite main winding and iron core member is 76 ohms. The lamp 36 is a conventional 250 watt HID sodium lamp and is shown schematically with lamp operating electrodes 38 operatively positioned proximate the ends of the operational arc tube 40.

A control winding 42 is positioned about a leg member 14 other than the leg member 16 about which the main winding 30 is wrapped and the control winding also encircles the flux path of only one of the closed magnetic paths which are formed by the core member and the main winding 30. It will be clear that with the control winding not energized, there are formed two magnetic paths, one of which is through the central transverse leg 16, a portion of the yoke member 20, one end transverse leg 18, and returning through the center member 16. The other magnetic path is provided through the center member 16, a portion of the yoke member 20, the transverse leg member 14, and returning through the main leg 12 to the center leg 16. Thus, the control winding 42 encircles one of these magnetic paths.

A bilateral switch 44 such as a suitable triac has output terminals 46 and a control terminal 48. In accordance with conventional switch design, the switch or switch means has a closed state in which conduction therethrough is provided at the output terminals 46 and the switch 44 also has an open state in which an open circuit is provided at the output terminals 46. The switch control terminal 48 is adapted to receive an actuating signal in order to control the conducting state of the switch 44 and the control winding 42 is connected to the output terminals 46 of the switch 44.

A signal generating means 50, which is shown in block form, is responsive to an operating condition of the HID lamp 36 and the signal generating means 50 has an output which is connected to the control terminal 48 of the switch 44 in order to actuate same to a closed state at a predetermined time in each half cycle of energizing potential for the HID lamp 46 as it normally operates. On closing of the switch 44, the resulting counter magnetomotive force generated in the closed magnetic path which is encircled by the control winding 42 decreases by a predetermined amount the inductance of the apparatus in order to control in a predetermined fashion the average power delivered to the HID lamp 36. While the signal generating means 50 is shown in block form, it can take many of a variety of designs such as disclosed in any of the foregoing listed U.S. Pat. Nos. 4,037,148; 3,886,405 or 3,590,316 with the preferred signal generating device shown in the referenced copending application which is filed concurrently herewith. As a specific example, with the control winding not energized, the lamp 36 as normally operating draws a current of approximately 2.5 amperes. With the control winding 42 energized, the impedance is 45 ohms and the lamp 36 as normally operating draws a current of approximately 4.6 amperes.

The present "scrapless" E-I core member can be very simply and inexpensively fabricated with the respective gaps 24, 26 and 28 readily controlled with respect to their dimensions. This is important since the inductance of the device is dependent in large measure upon the dimensions of the respective gaps.

Figure 2:
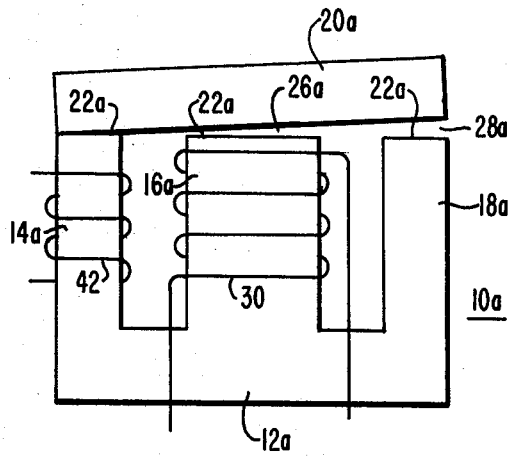
FIG. 2 is a schematic showing of a variable inductor of alternative construction wherein the I-conformed member is tilted with respect to the E-conformed member to provide the non-magnetic gaps.

An alternative device embodiment **10*a* is shown in FIG. 2 wherein the yoke member 20*a* is identically formed with the main leg member 12*a* but is tilted at an angle of 3° with respect to the projecting ends 22*a* of the transverse leg members 14*a*, 16*a* and 18*a* in order to provide non-magnetic gaps 26*a* and 28*a***.

Figure 3:
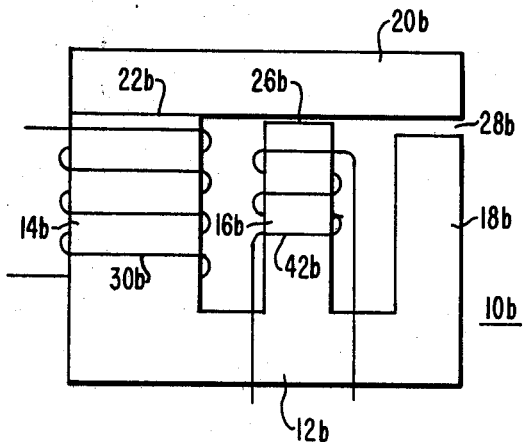
FIG. 3 is a diagrammatic showing of still another form of variable inductor wherein only two non-magnetic gaps are utilized and the positioning of the main winding and the control winding are reversed.

Another alternative embodiment **10*b* is shown in FIG. 3 wherein the yoke member 20*b* abuts against the end 22*b* of transverse leg member 14*a* with non-magnetic gaps 26*b* and 28*b* provided between the remaining transverse leg members 16*b* and the yoke 20*b*. Also in this embodiment, the positions of the main winding 30*b* and the control winding 42*b* are reversed. As a specific example, the gap 26*b* has an average spacing of 72 mils (1.8 mm) and the gap 28*b*** has an average spacing of 160 mils (4 mm).

In all of the foregoing embodiments, a standard scrapless type of magnetic iron lamination punching is used with no additional shunt members required with the relatively critical tolerances in the non-magnetic gaps simply and inexpensively maintained.

I claim:

1. A variable inductance apparatus for ballasting a high-intensity discharge lamp, said apparatus comprising:

a. a laminated iron core member having an E-I configuration wherein the E-conformed part thereof comprises a main leg member having three transverse leg members connected thereto proximate the ends and mid-portion thereof and projecting at right angles therefrom; the I-conformed part of said core member having dimensions similar to said main leg member and positioned as a yoke proximate the projecting ends of said transverse leg members; and non-magnetic gaps having predetermined spacings provided intermediate said yoke member and at least two of the proximate projecting ends of said transverse leg members;

b. a main winding having a predetermined number of turns wrapped about one of said transverse leg members; means for connecting said main winding in series circuit relationship with an AC energizing source and said high-intensity discharge lamp to be ballasted; and said main winding and said core member coacting to provide two closed magnetic paths;

c. a control winding wrapped about a leg member of said core member other than the said leg member about which said main winding is wrapped and said control winding also encircling the flux path of only one of said closed magnetic paths which are formed by said core member and said main winding; and d. bilateral switch means having output terminals and a control terminal, said switch means having a closed state in which conduction therethrough is provided at said output terminals, and said switch means having an open state in which an open circuit is provided at said output terminals, and said control terminal is adapted to receive an actuating signal to control the conducting state of said switch means; said control winding connected to the control terminal of said switch means to actuate and switch means to a closed state at a predetermined time in each half cycle of energizing potential for said HID lamp as normally operated; whereby on closing of said switch means the resulting counter mmf generated in one of said closed magnetic paths of said core member decreases by a predetermined amount the inductance of said apparatus to control in a predetermined fashion the average power delivered to said HID lamp.

2. The apparatus as specified in claim 1, wherein said high-intensity discharge lamp is a high-pressure sodium discharge lamp.

3. The apparatus as specified in claim 1, wherein said one transverse leg member about which said main winding is wrapped is that said transverse leg member which connects to said main leg member proximate the mid portion thereof, and said control winding is wrapped about one of the other of said transverse leg members.

4. The apparatus as specified in claim 3, wherein said non-magnetic gaps are provided intermediate said yoke member and all of the projecting ends of said transverse leg members.

* * * * *